United States Patent [19]

Deneke et al.

[11] 3,942,635

[45] Mar. 9, 1976

[54] SLIDE-FASTENER PACKAGE

[75] Inventors: Karlheinz Deneke, Kettwig; Hans Paas, Neviges, both of Germany

[73] Assignee: Opti-Holding AG, Glarus, Switzerland

[22] Filed: Feb. 6, 1975

[21] Appl. No.: 547,585

Related U.S. Application Data

[62] Division of Ser. No. 345,215, March 26, 1973, Pat. No. 3,913,297.

[30] Foreign Application Priority Data

Aug. 18, 1972 Germany ..... 2240815
Aug. 25, 1972 Germany ..... 2241766

[52] U.S. Cl. ..... 206/338; 206/810; 206/344; 206/477

[51] Int. Cl.[2] ..... B65D 85/24

[58] Field of Search ..... 206/338, 343–345, 206/447, 810, 477

[56] References Cited

UNITED STATES PATENTS 1,422,233 7/1922 Stern ..... 206/238

*Primary Examiner*—William Price
*Assistant Examiner*—Douglas B. Farrow
*Attorney, Agent, or Firm*—Karl F. Ross; Herbert Dubno

[57] ABSTRACT

In order to wrap individual slide-fastener units in plastic display envelopes enabling the testing of their sliders without removal from the package, a continuous strip of preferably transparent thermoplastic sheet material is advanced together with an integral series of such units past a cutting station where the units are separated from one another with simultaneous severance of the plastic strip. The latter, on approaching the cutting station, is folded from opposite sides around the outer edges of the carrier bands supporting the interlinked coupling elements of the units, the resulting flaps being kept spaced apart by a median gap exposing the juxtaposed coupling elements as well as the associated slider. The flaps are fastened with light adhesive bonding to opposite ends of the stringer tapes cut from the carrier bands.

7 Claims, 6 Drawing Figures

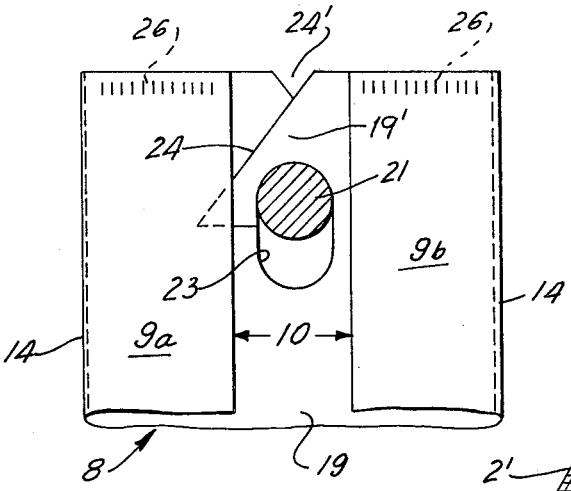
FIG. 4
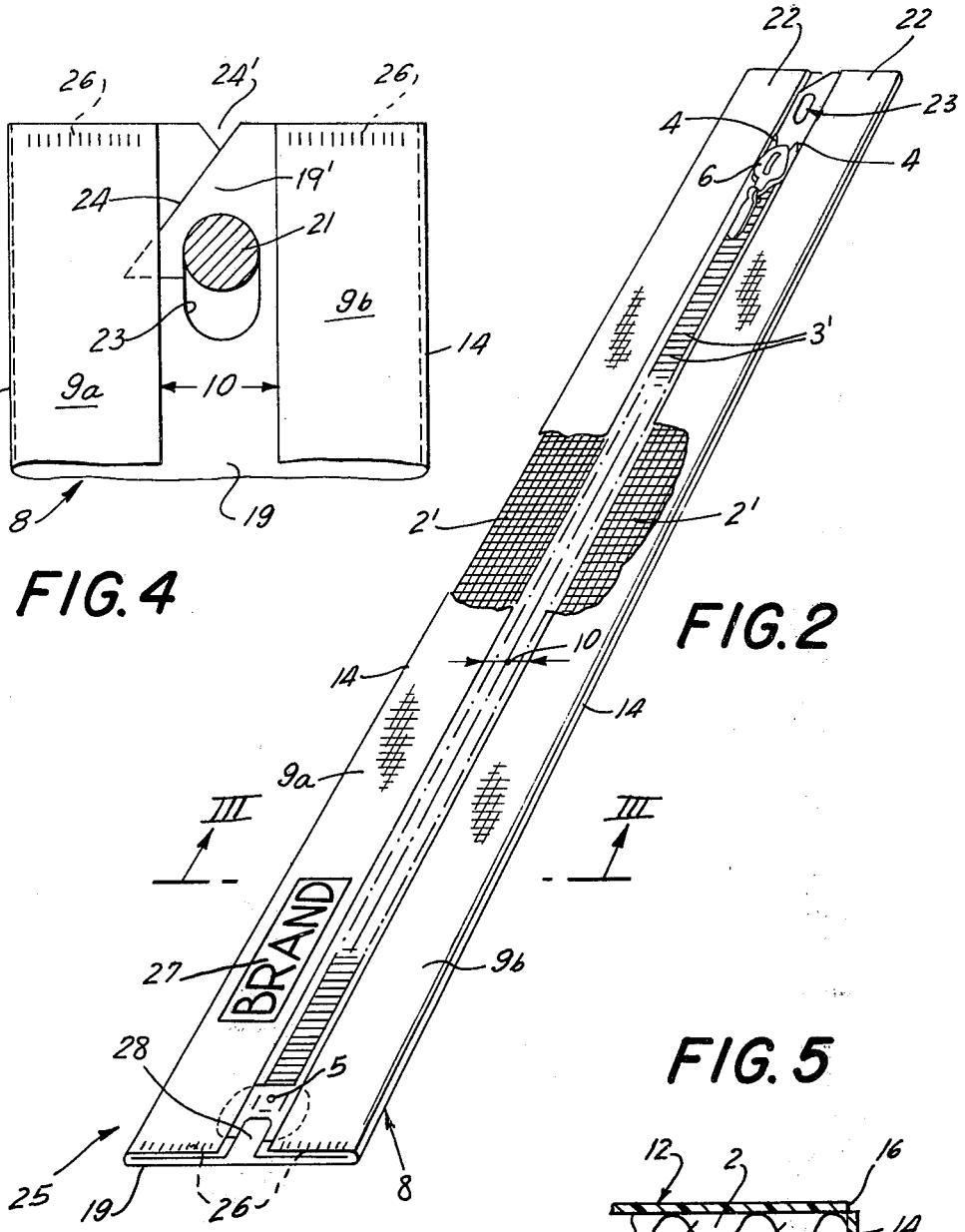
FIG. 2
FIG. 5
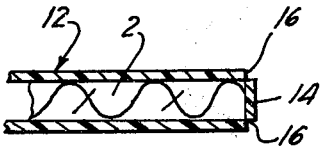
FIG. 3
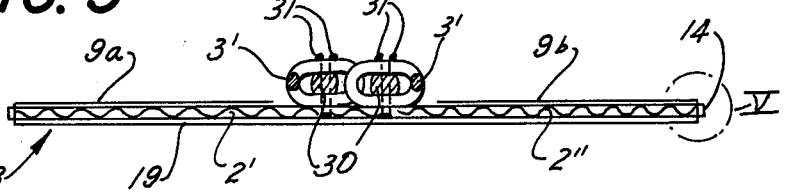

SLIDE-FASTENER PACKAGE

This is a division of application Ser. No. 345,215, filed Mar. 26, 1973, now U.S. Pat. No. 3,913,297.

FIELD OF THE INVENTION

Our present invention relates to individually packaged slide-fastener units and to a process for packaging such units.

BACKGROUND OF THE INVENTION

Slide fasteners of various sizes and colors are generally marketed in units each consisting, essentially, of two juxtaposed coupling elements on respective carriers (also known as stringer tapes) and a slider engaging these elements for alternately interlinking and separating their coupling heads. The coupling elements may terminate in individual or joint end stops, e.g. a joint bottom stop permanently interconnecting the lower extremities of the coupling elements and separate top stops preventing the detachment of the slider. The terms "top" and "bottom," as used in this connection, identify the starting and stopping positions of the separating stroke of the slider and are not necessarily related to the geometrical orientation of the fastener.

It is known, e.g., from commonly owned U.S. Pat. Nos. 3,340,594, 3,353,233 and 3,353,256, to manufacture an integral series of such fastener units by interlinking two complementary fastener chains secured to respective carrier bands, forming longitudinally spaced windows in these chains between the carrier bands to divide each chain into a row of coupling elements, and introducing a respective slider into each window for engagement with an adjoining pair of coupling elements. The windows serve for separation of the top and bottom stops of successive units; where the coupling elements consist of thermoplastic material, these end stops are advantageously formed by monolithic fusion of terminal parts of the two coupling elements and of a superimposed stiffening foil of like material, as disclosed in the above-identified patents and also in commonly owned U.S. Pat. No. 3,482,292.

The conventional method of packaging individual fastener units, obtained by severance of an integral series of such units at the aforementioned windows, involves separate manufacture of envelopes into which these units have to be individually stuffed. Since this procedure is time-consuming and correspondingly adds to the cost of the slide fastener, manufacturers heretofore frequently elected to dispense with such packaging and to suspend the unwrapped fastener units from racks where they would be handled by customers and would thus be subject to soiling.

OBJECTS OF THE INVENTION

An important object of our present invention is to provide a simple and inexpensive process for individually packaging such slide-fastener units.

A related object if to provide an attractively packaged slide-fastener unit which protects the soilable carriers or stringer tapes thereof while giving access to the slider so as to let a customer test its operation before purchasing.

SUMMARY OF THE INVENTION

These objects are realized, pursuant to our present invention, by intermittently or continuously advancing the aforedescribed integral series of fastener units along a predetermined path together with a strip of flexible, preferably thermoplastic sheet material of a sufficient width to let marginal portions of that strip project laterally beyond the carrier bands that are subsequently cut into stringer tapes. These projecting marginal portions are progressively folded about the carrier bands with maintenance of a longitudinal gap between confronting edges of the folded-over portions, the gap exposing the interconnected coupling elements and giving access to their sliders. Thereafter, the carrier bands and the strip are jointly severed, together with the integrally fused end stops if present, at the windows forming the boundaries between adjoining units.

In this way, an envelope is produced whose rear wall is formed from a central strip portion, the envelope further having two transversely spaced front flaps constituted by the folded-over marginal portions of the original strip. The ends of the envelopes may be releasably fastened to the ends of the stringer tapes, as by a light adhesive bond formed between these tapes and the front flaps. The strip, or at least the marginal portions thereof forming the front flaps, may be transparent to reveal the color of the underlying stringer tapes.

According to another feature of our invention, the otherwise continuous rear wall of the envelope is provided near one end, along its centerline, with an aperture by which the package may be suspended from a hook, nail or the like. A narrow angular slit may extend from this aperture to the adjoining end to facilitate the mounting of the package on a supporting rod and its subsequent disengagement from that rod; part of the slit is advantageously overlain by the front flap to guard against accidental detachment. These suspension apertures are therefore preferably produced, together with the adjoining slits, at a stage preceding the folding of the marginal portions.

The strip-forming blank of thermoplastic sheet material may be preshaped, e.g., by scoring or perforating, to have marked thereon a set of longitudinal crease lines along which it is folded about the carrier bands. If these bands also consist of thermoplastic material (e.g. filaments woven into fabrics), the adhesive bonding of the tape ends at the front flaps and/or the rear wall of the associated envelope may be performed at elevated temperature and under light pressure during the severing step to produce a frangible heat seal.

BRIEF DESCRIPTION OF THE DRAWING

The above and other features will now be described in detail with reference to the accompanying drawing in which:

FIG. 2 is a similar perspective view of a slide-fastener package obtained from the assembly of FIG. 1;

FIG. 3 is a cross-sectional view taken on the line of III — III of FIG. 2 but drawn to a larger scale;

FIG. 4 is an enlarged plan view of a terminal portion of the unit of FIG. 2 as seen in the direction of arrow IV;

FIG. 5 is a still further enlarged view of the area V of FIG. 3; and

SPECIFIC DESCRIPTION

Figure 1:
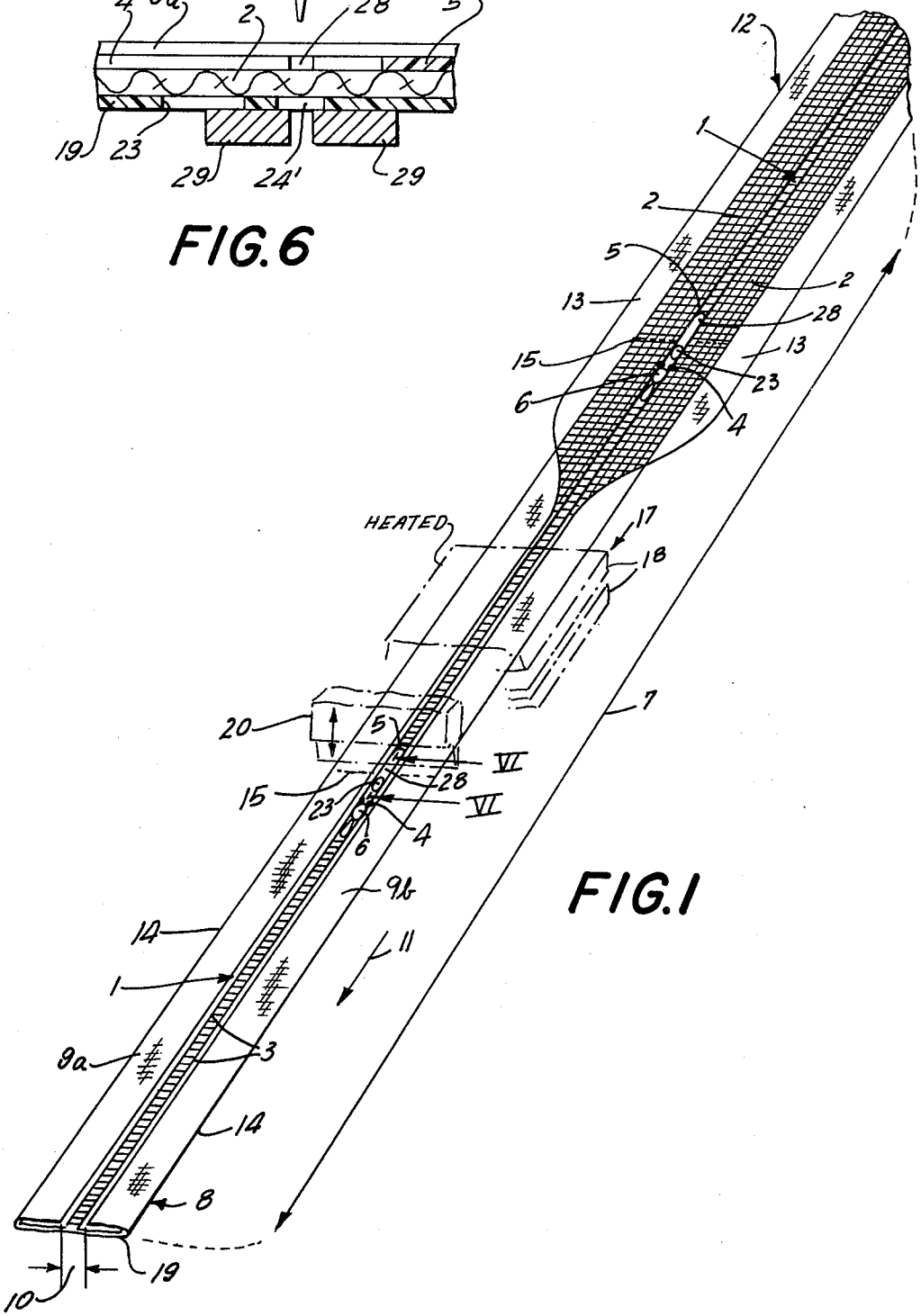
FIG. 1 is a perspective overall view of an integral series of fastener units in the process of being enveloped in an accompanying strip of transparent thermoplastic sheet material, with associated forming and cutting tools indicated diagrammatically.

In FIG. 1 we have shown part of an assembly 7 of an integral series of fastener units 1 and of a continuous strip 12 longitudinally coextensive therewith, the width of the strip exceeding that of a pair of carrier bands 2 forming part of the interconnected fastener units. The series of units 1 further includes a pair of complementary fastener chains 3 which are interlinked over the entire length thereof, except at points where sliders 6 are inserted in the vicinity of split top stops 4 that are separated by windows 28 from bottom stops 5 of adjoining units. In the region of these top stops 4, but at locations offset from a transverse branch 28′ (FIG. 6) of each window 28, the sheet 12 is formed with a centrally located aperture 23 and an adjoining oblique slit 24 terminating at a triangular cutout 24′ (FIGS. 4 and 6) in line with branch 28′. Cutouts 24′ and window branches 28′ register with transverse lines 15 which mark the boundaries between adjoining units 1 to be cut from assembly 7 with the aid of a vertically reciprocable blade 20; the latter may be ultrasonically vibrated to insure a clean cut.

Marginal zones 13 of sheet 12, projecting laterally beyond the bands 2, are folded around these bands on the approach of a station 17 where a pair of heated dies 18 are movable toward each other to clamp the assembly between them under a pressure sufficient to maintain the shape of a pair of front flaps 9*a*, 9*b* formed from the folded-over strip portions 13. The advance of the assembly 7, in the direction of arrow 11, may be intermittent and may be halted during operation of dies 18 and cutter 20; a further tool, not shown, serves to punch the apertures 23 upstream of fixing station 17. Together with a substantially continuous central portion 19, underlying the bands 2 and the fastener chains 3, these flaps 9*a*, and 9*b* form an envelope 8 around each unit 1 after severance of such unit along with a coextensive strip section from the remainder of the assembly by the operation of cutter 20. With continuous advance of the assembly, the associated tools may move codirectionally therewith for short distances during a working stroke and return upon withdrawal as is well known per se.

The flaps 9*a* and 9*b* are spaced apart by a central longitudinal gap 10 whose width is sufficient to expose the fastener chains 3 and the sliders 6. Thus, the finished package 25 shown in FIGS. 2 and 3 allows the testing of the slider which may be moved between top stop 4 and bottom stop 5 over the full length of a pair of coupling elements 3′ cut from the chains 3. The strip 12 may be preshaped to form crease lines 16 (FIG. 5), single or in pairs, along the narrow edges 14 of the resulting envelopes 8, thereby facilitating the entry of the marginal portions 13 into the shaping and fixing station 17 in their folded-over position which they retain upon emerging from that station. Guide rails or rollers, not shown, may be provided ahead of station 17 to keep the strip initially spread out, especially in the region of the punching station forming the apertures 23. The integral series of fastener units 1, with end stops 4, 5 and windows 28, 28′ already formed therein, may be continuously delivered (e.g. by an apparatus as shown in U.S. Pat. No. 3,353,256) to a point where it is juxtaposed with the strip 12 continuously arriving from a supply reel or the like.

Figure 6:
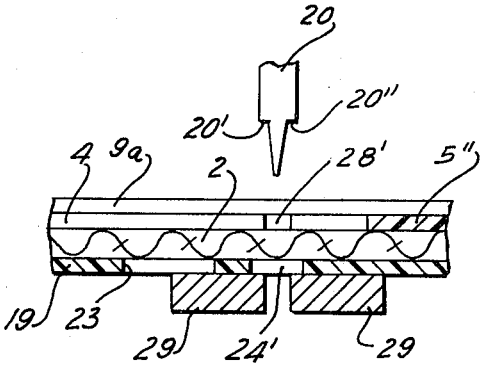
FIG. 6 is a fragmentary cross-sectional view taken on the line VI — VI of FIG. 3, also drawn to a larger scale.

The ends of envelope 8 are sealed along transverse seams 26 (FIG. 2), with releasable bonding of front flaps 9*a* and 9*b* to the underlying stringer tapes 2′ cut from bands 2. As illustrated in FIG. 6, the formation of the seams 26 may coincide with the severing of a package 25 from the assembly 7 by the tool 20 of the cutting station which for this purpose is provided with shoulder 20′, 20″ bearing through the flaps 9*a*, 9*b*, the bands 2 and the central strip portion 19 upon a slotted anvil 29 under relatively light pressure. The cutting tool 20 may be heated for this purpose, especially at its shoulder 20′ and 20″. If heat sealing is not feasible, the bands 2 may be precoated at seams 26 with a suitable bonding agent, e.g. by means of an applicator disposed just ahead of station 17.

As best seen in FIG. 4, the slit 24 interconnecting the aperture 23 and the cutout 24′ is of angular configuration and has its vertex overlain by the front flap 9*a*. A triangular part 19′ of rear wall 19, bounded by the slit 24, can be resiliently bent back to facilitate the introduction of a suspension rod 21 into the aperture 23 even if the end of that rod is not accessible. In the same way a selected package 25 can be removed from the suspension rod 21 without disturbing other packages hanging on the same rod.

An advertising message 27 or other information may be printed onto either or both front flaps 9*a*, 9*b* as shown in FIG. 2.

Since the seams 26 can be easily opened, the envelope 8 can be readily detached from the fastener unit 1 and either discarded by the purchaser or reused for the packaging of similar goods.

The interlocking fastener chains 3 are conventionally formed as helicoidally coiled or meandering monofilaments with fabric cores 30, secured to their supporting stringer tapes 2′ by stitching 31 (FIG. 3).

We claim:

1. A package comprising a slide-fastener unit with juxtaposed coupling elements on respective stringer tapes and a slider engaging said coupling elements for alternately interlinking and separating same, and an envelope of flexible sheet material longitudinally folded about lateral outer edges of said stringer tapes, said envelope forming a substantially continuous rear wall and two front flaps separated by a longitudinal central gap exposing said coupling elements over their entire length and giving access to said slider.

2. A package as defined in claim 1 wherein said rear wall is provided along its centerline with a suspension aperture adjacent one end of said envelope, said coupling elements terminating short of said aperture.

3. A package as defined in claim 2 wherein said aperture communicates with a narrow angular slit opening onto said one end, said slit being partly overlain by one of said front flaps.

4. A package as defined in claim 2 wherein said coupling elements are provided with top and bottom end stops, said aperture being disposed between said one end and the adjoining end stop.

5. A package as defined in claim 4 wherein said coupling elements consist of thermoplastic materials and are integral with said end stops.

6. A package as defined in claim 1 wherein said front flaps are detachably bonded to said stringer tapes at the ends of said envelope.

7. A package as defined in claim 1 wherein said front flaps are transparent.

* * * * *